US006550653B2

(12) United States Patent
Matthews

(10) Patent No.: US 6,550,653 B2
(45) Date of Patent: Apr. 22, 2003

(54) CARRYING DEVICE FOR A USER TO CARRY AN ARTICLE

(76) Inventor: Kimberly S. Matthews, 223 Queen Anne Club Dr., Stevensville, MD (US) 21666

( * ) Notice: Subject to any disclaimer, the term of this patent is extended or adjusted under 35 U.S.C. 154(b) by 0 days.

(21) Appl. No.: 09/820,811

(22) Filed: Mar. 30, 2001

(65) Prior Publication Data

US 2002/0139826 A1 Oct. 3, 2002

(51) Int. Cl.[7] ..... A45F 3/14
(52) U.S. Cl. ..... 224/250; 224/258; 224/264
(58) Field of Search ..... 224/257, 258, 224/264, 250, 607

(56) References Cited

U.S. PATENT DOCUMENTS 4,724,989 A * 2/1988 Silberberg ..... 224/250
4,804,025 A * 2/1989 Bear ..... 224/258
5,566,871 A * 10/1996 Weintraub ..... 224/264
5,775,495 A * 7/1998 Lang ..... 190/102
5,992,176 A * 11/1999 Arbogast ..... 2/268

* cited by examiner

*Primary Examiner*—Stephen K. Cronin

(57) ABSTRACT

A carrying device configured to a person to comfortably and easily carry one or more articles such as beach chair, folding chair, bag, cooler, table, blanket, toy and floating device. The carrying device includes a shoulder strap connected to a substantially rigid support, which is connected to at least one carrying strap for releasably and selectively connecting and disconnecting one or more articles to the carrying device.

19 Claims, 3 Drawing Sheets

CARRYING DEVICE FOR A USER TO CARRY AN ARTICLE

FIELD OF THE INVENTION

The present invention is directed to a carrying device configured for carrying an article such as a beach chair, folding chair, bag, cooler, table, blanket, toy, floating device, etc. The carrying device is configured to be worn by a user desiring to carry such articles.

BACKGROUND OF THE INVENTION

There exists many devices for transporting articles by a person. Many of these devices are worn by a user so that the articles can be connected to and carried by the user.

Carrying articles in a comfortable and easy manner is desirable. One particular use involves the carrying of beach accessories, including beach chairs, folding chairs, bags, coolers, tables, blankets, toys, floating devices and other articles normally associated with enjoyment of a day at the beach. The larger articles such as beach chairs are heavier, more cumbersome and difficult for a person to carry to and from the beach. It is desirable to have a carrying device that can be releasably connected to one or more such articles in a manner that these articles can be comfortably and easily transported to and from a beach. More specifically, it is desirable to have a carrying device that can stabilize the load (i.e. prevent article from tilting and/or moving around too much relative to the user) and to spread the weight of the article being carried comfortably to the user.

SUMMARY OF THE INVENTION

An object of the present invention is to provide an improved carrying device configured for a user to carry an article such as a beach chair, folding chair, bag, cooler, table, blanket, toy, floating device, etc.

A second object of the present invention is to provide a carrying device comprising a shoulder strap connected to a substantially rigid support provided with at least carrying strap.

A third object of the present invention is to provide a shoulder strap having a portion stiffened by a substantially rigid support, which portion supports a carrying strap.

A fourth object of the present invention is to provide a carrying device having an adjustable length shoulder strap and at least one adjustable length carrying strap.

A fifth object of the present invention is to provide a carrying device including a shoulder strap connected to a substantially rigid support with at least one carrying strap connected to an oriented transversely relative to the substantially rigid support.

The carrying device according to the present invention is configured for a person to carry one or more articles such as a beach chair, folding chair, bag, cooler, table, blanket, toy, floating device, etc. easily and comfortably. The carrying device is configured to stabilize the article so there is not substantial tilting and /or excessive movement of the article relative to the person. Further, the carrying device according to the present invention is configured to be comfortable to wear when carrying one or more such articles.

The carrying device according to the present invention is worn by a person using the carrying device. The carrying device according to the present invention includes a shoulder strap to be worn over a shoulder of the person, which shoulder device is connected to a substantially rigid support. Preferably, the shoulder strap is connected to opposite ends of the substantially rigid support to stabilize the support. Preferably, the support and shoulder strap are configured so that the substantially rigid support is oriented substantially horizontally during use. In a preferred embodiment, the shoulder strap and substantially rigid support are a single or integrated unit. For example, the shoulder strap can be made of two separate layers of fabric material (e.g. nylon fabric) connected together (e.g. fabric tube, two layers sewn together) with at least one stiffener such as a rod, tube, plate or other suitable configuration disposed between the two separate layers at one or more portions of the shoulder belt. Preferably, an end of the rod, tube or plate is rounded or shaped so as to prevent wear between the ends of the substantially rigid support and the flexible fabric shoulder strap. Further, preferably, the substantially rigid support is captured between the separate layers of fabric to prevent relative movement along the length of the shoulder strap and/or movement along the width of the shoulder strap. In this manner, the substantially rigid support is fixed relative to the shoulder strap, and the shoulder strap can be properly sized or selected in length so that the substantially rigid support is suspended from the person's shoulder, and preferably is oriented substantially horizontally approximately waist high or higher.

In a preferred embodiment, the shoulder strap is adjustable in length and is provided with a shoulder pad to spread and distribute the weight on the person's shoulder wearing the carrying device according to the present invention. The adjustable length shoulder strap allows different users to utilize the same carrying device according to the present invention, and/or a particular user can adjust the length of the carrying device for a particular sized or shaped article, and/or adjustable to provide carrying comfort of the article for the user.

The carrying device according to the present invention is provided with at least one carrying strap configured for releasably connecting one or more articles to the carrying device. For example, a carrying strap can be an adjustable length strap (e.g. nylon fabric) configured for releasably connecting to one or more articles. In one embodiment, the carrying strap is provided with a snap-type buckle configured to allow adjustment of the length of the carrying strap. The snap-type buckle can be opened and closed to connect and disconnect an article as desired. In a preferred embodiment, the carrying device according to the present invention is provided with plural carrying straps, again preferably adjustable in length. In a more preferred embodiment, three (3) separate adjustable length carrying straps equally spaced along a length of the substantially rigid support are provided to securely connect to an article such as a beach chair and securely stabilize the beach chair from rotating and/or excessive movement relative to the person carrying the beach chair.

DETAILED DESCRIPTION OF PREFERRED EMBODIMENTS

Figure 1:
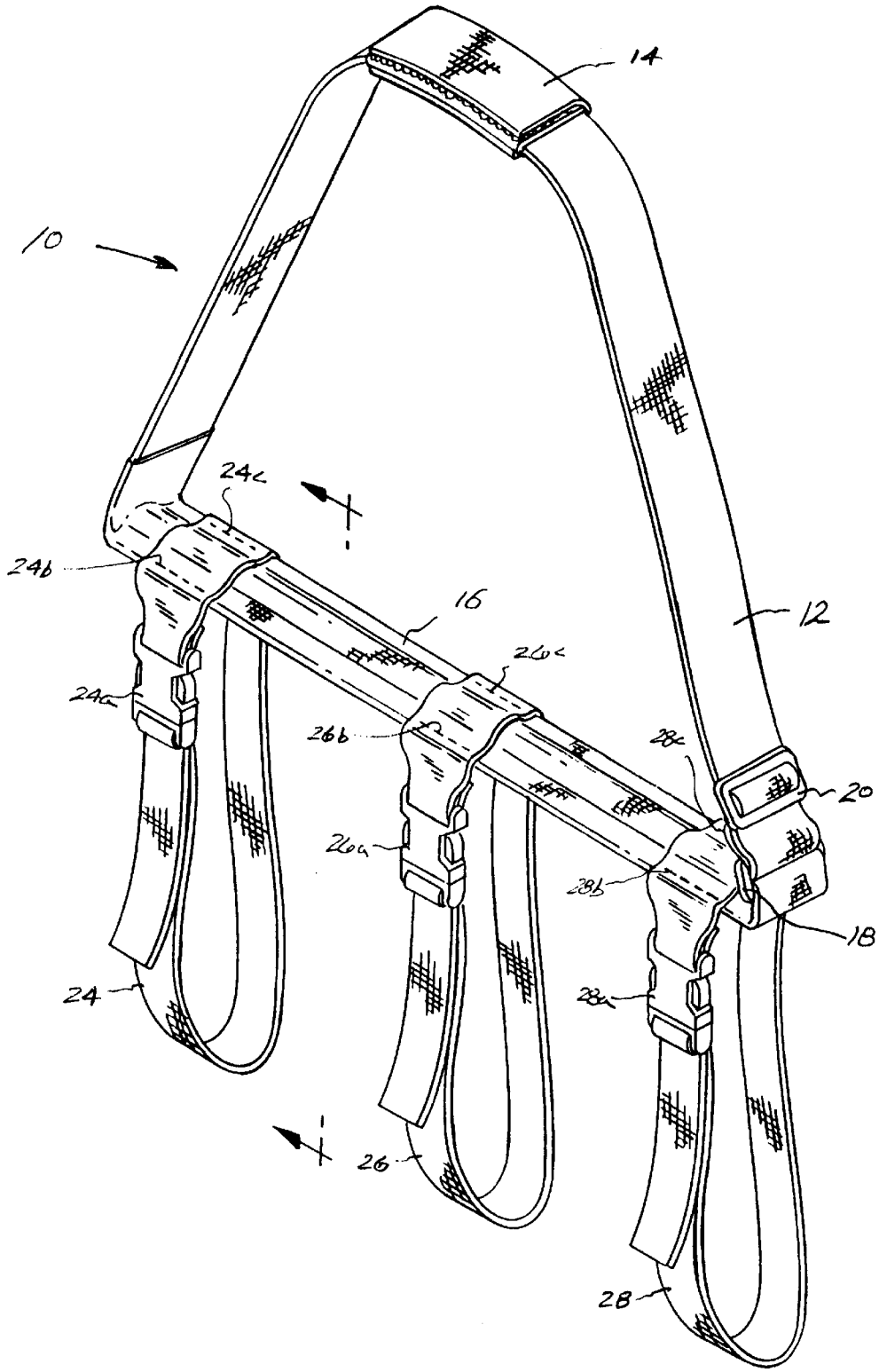
FIG. 1 is a perspective view of a carrying device according to the present invention.
Figure 2:
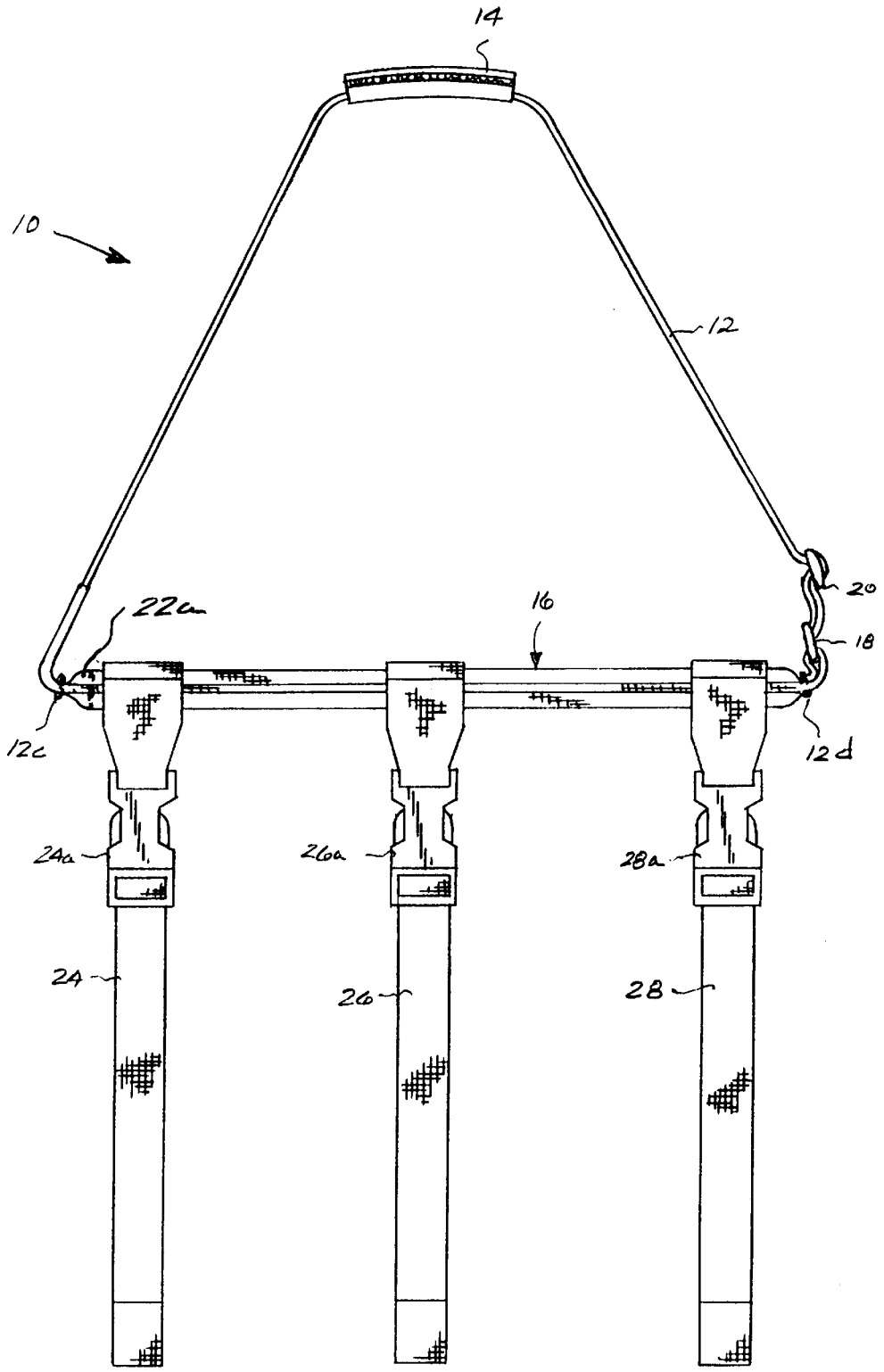
FIG. 2 is a side elevational view of a carrying device according to the present invention shown in FIG. 1.

A carrying device 10 according to the present invention as shown in FIGS. 1–4.

The carrying device 10 includes a shoulder strap 12, provided with a shoulder pad 14, connected to a substantially rigid support 16. The shoulder strap 12, for example, can be made of leather or fabric (e.g. nylon web fabric) selected to be suitably strong for carrying the weight of one or more articles such as a beach chair. In a preferred embodiment, the shoulder strap 12 is constructed of two (2) separate layers of fabric web connected together (e.g. fabric tube, or two separate layers stitched along one or both edges of the shoulder strap). The shoulder pad 14 can be one or more additional layers of material (e.g. fabric, foam, composite, leather strip, plastic strip, or other suitable load distributing material) permanently connected and/or releasably connected at one or more positions along the length of the shoulder strap 12. In one embodiment, the shoulder pad 14 is provided with velcro fastener so that the shoulder pad can be easily replaced and/or washed and then replaced.

The shoulder strap 12 is preferably connected on either side of the substantially rigid support 16. In the embodiments shown in FIGS. 1–4, the shoulder strap is connected to opposite ends of the support 16. In this manner, the support 16 is suspended in a stable manner from the shoulder strap 12. Alternatively, different and/or additional connections between the shoulder strap and the support 16 can be made for particular applications of the carrying device according to the present invention. Further, preferably the shoulder strap 12 is adjustable in length to accommodate different size persons using the carrying device 10, and/or a particular person being able to adjust the length of the shoulder strap 12 for carrying different articles or adjustable for comfort. The shoulder strap 12 can be made adjustable in length in various manners. For example, the adjustable length shoulder strap 12 is connected at one end to loop 18, and wraps around the loop 18 and connects to buckle 20. The buckle 20 is configured to be slidable with resistance along the length of the shoulder strap 12 folding one end of the shoulder strap over the main portion of the shoulder strap 12.

In a preferred embodiment, the support 16 is defined by a stiffened portion of the shoulder strap 12. Specifically, a stiffener such as a rod, tube, plate, or other suitable configuration is connected externally and/or internally to a portion of the shoulder strap to stiffen this particular portion of the shoulder strap 12. In the embodiments shown in FIGS. 1–4, a tube 22 (e.g. plastic tube, metal tube, ceramic tube, plastic rod, metal rod, wood dowel, board, etc.) is disposed between the two (2) separate fabric layers 12*a* and 12*b*, shown in FIG. 4. The tube 22 is provided with a plug 22*a* or a cap shaped (e.g. rounded) to prevent wear between the ends of the tube 22 and the shoulder strap 12. The tube 22 is captured between the two (2) separate fabric layers 12*a* and 12*b* in the width direction, shown in FIG. 4, and preferably is captured in the length direction of the shoulder strap 12 by sewing the shoulder strap transversely at 12*c* and 12*d*, shown in FIG. 2. The shoulder strap 12 can be constructed of a single fabric web folded in half along its length and sewed together along one edge of the shoulder strap. Alternatively, the shoulder strap 12 can be made of two separate fabric webs sewn together at the edges along both edges of the shoulder strap such as at 12*e* and 12*f*, shown in FIG. 4. To further prevent the movement of the tube 22 from moving off center along the width of the shoulder strap 12, shown in FIG. 4, additional sewing of the shoulder strap together closer on either side of the tube 22 can be provided to further capture the tube 22 at the center of the width of the shoulder strap 12.

The carrying device 10 is provided with at least one carrying strap. In a preferred embodiment, the carrying device 10 is provided with three (3) carrying straps 24, 26 and 28. Preferably, the carrying straps 24, 26, 28 are equally spaced along the length of the support 16 to distribute the load along the length thereof and to stabilize the connection with the one or more articles to be carried by the carrying device 10. The carrying straps 24, 26, 28 are configured to be connected to one or more articles. For example, the carrying straps 24, 26, 28 can be provided with snap-type buckles 24*a*, 26*a*, 28*a* to allow the carrying straps 24, 26, 28 to be opened and closed repeatedly to connect and disconnect the one or more articles to and from the carrying device 10. Further, preferably, the buckles 24*a*, 26*a*, 28*a* are configured to allow the length of the carrying straps 24, 26, 28 to be adjusted.

The carrying straps 24, 26, 28 are connected to the support 16. The carrying straps 24, 26, 28 can be connected in various manners. In the embodiment shown in FIGS. 1–4, the carrying straps 24, 26, 28 are oriented transversely relative to the support 16. Further, the carrying straps 24, 26, 28 are sewn at 24*b* and *c*, 26*b* and *c*, 28*c* and *d*. Further, the carrying straps 24, 26, 28 are disposed on top of the support 16 to take advantage of the strength of the carrying straps 24, 26, 28 being suspended by the support 16.

Figure 3:
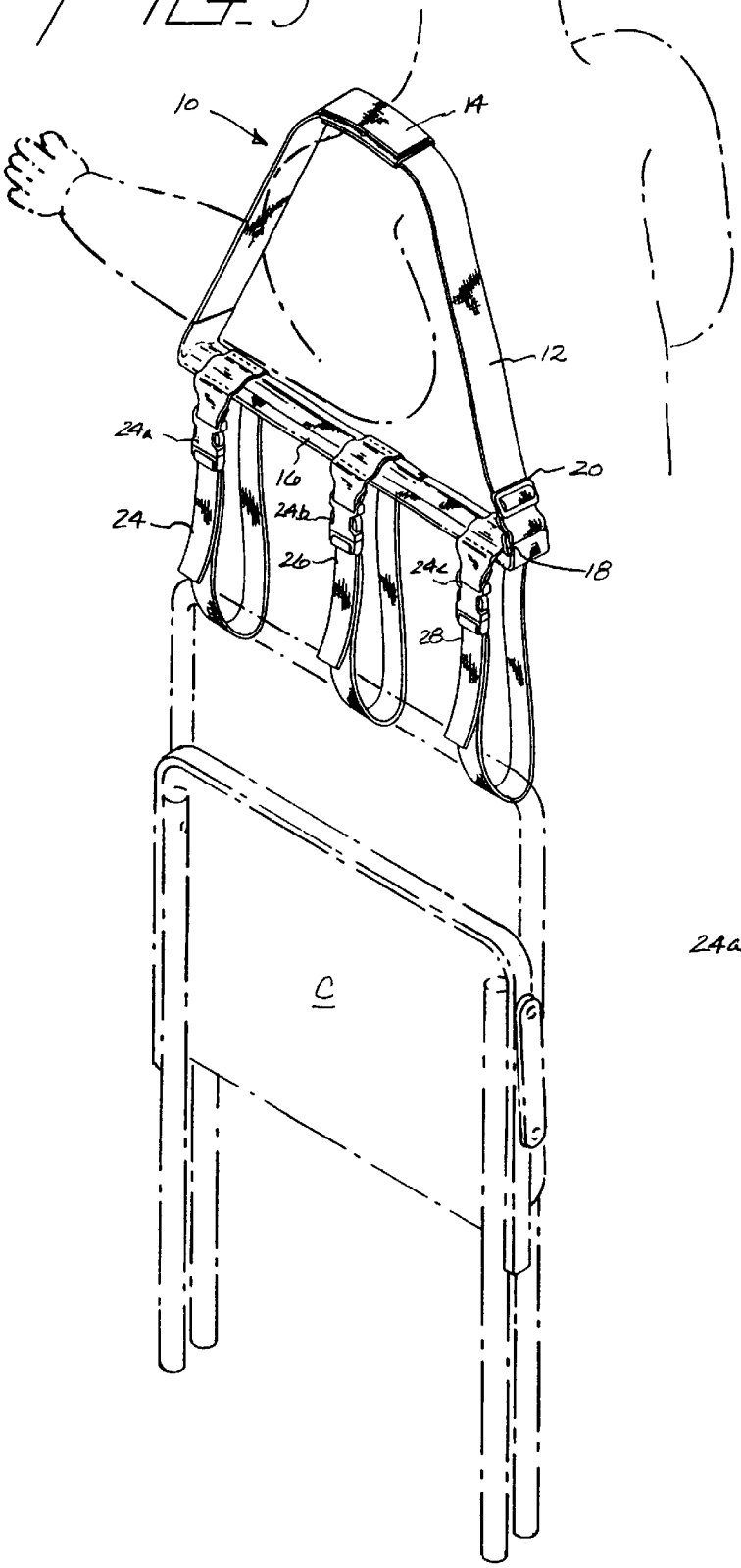
FIG. 3 is a perspective view of a carrying device according to the present invention, shown in FIGS. 1 and 2 as being worn by a person.
Figure 4:
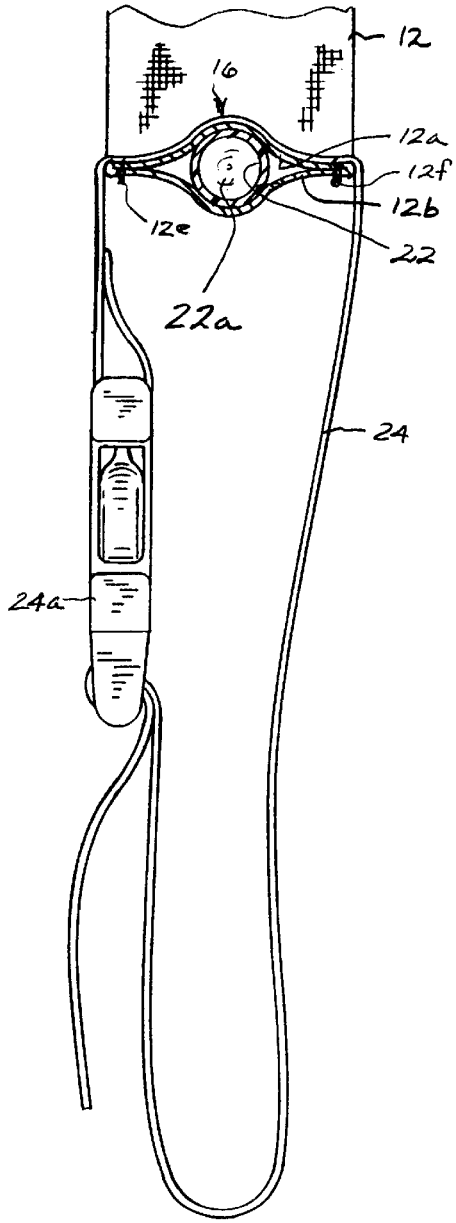
FIG. 4 is a cross-sectional broken away view through the substantially rigid support of the carrying device according to the present invention, and shown in FIGS. 1–3.

In use, an article such as beach chair C shown in FIG. 3, can be connected to the carrying device 10 as shown. Specifically, the carrying straps 24, 26, 28 are opened via the buckles 24*a*, 26*a*, 28*a*, respectively. In this manner, the beach chair C is stably carried underneath the left arm and shoulder of the person using the carrying device 10. In this manner, the beach chair C cannot tilt nor move excessively relative to the person using the carrying device 10. To unload the beach chair C, the buckles 24*a*, 26*a*, 28*a* are opened to release the beach chair C from the carrying device 10. To again load the carrying device 10 with the beach chair C the reverse steps occur.

What is claimed is:

1. A carrying device configured to facilitate a user carrying an article such as a beach chair, folding chair, bag, cooler, table, blanket, toy and floating device, said device comprising:

a substantially rigid support, said support including a support member disposed within a fabric web;

a shoulder strap connected to said support, said shoulder strap configured for suspending said support from a shoulder of the user, said shoulder strap being constructed of two separate layers of said fabric web connected together, and said support member being disposed within a portion of said shoulder strap; and at least one carrying strap connected to said support, said carrying strap configured for releasably connecting and suspending the article to be carried by the user.

2. A device according to claim 1, wherein a first end of said shoulder strap is connect to a first end of said support, and a second end of said shoulder strap is connected to a second end of said support.

3. A device according to claim 1, wherein said shoulder strap and said support are configured so that said support is oriented substantially horizontal during use of said device.

4. A device according to claim 1, wherein said shoulder strap is adjustable in length.

5. A device according to claim 1, wherein said carrying strap is adjustable in length.

6. A device according to claim 1, wherein said device includes at least two carrying straps.

7. A device according to claim 1, wherein said device includes at least three carrying straps.

8. A device according to claim 7, wherein said three carrying straps are equally spaced along said support.

9. A device according to claim 1, wherein said support includes at least one support member from the group consisting of a rod, tube and plate.

10. A device according to claim 9, wherein said tube is a plastic tube.

11. A device according to claim 1, wherein said support member is secured from movement within said shoulder strap.

12. A device according to claim 1, wherein said fabric web is made of nylon fabric.

13. A device according to claim 1, wherein said carrying strap is oriented transversely relative to said support.

14. A device according to claim 1, wherein said carrying strap is oriented transversely relative to said support, and said carrying strap is sewn to said fabric web.

15. A device according to claim 1, wherein said shoulder strap and said carrying strap are made of nylon fabric.

16. A device according to claim 1, wherein said shoulder strap is provided with a shoulder pad.

17. A device according to claim 1, wherein said carrying strap is provided with a buckle configured to allow adjustment of a length of said carrying strap.

18. A carrying device configured to facilitate a user carrying an article such as a beach chair, folding chair, bag, cooler, table, blanket, toy and floating device, said device comprising:

an adjustable length shoulder strap made of two separate layers of fabric material connected together;

a substantially rigid support disposed within a portion of said shoulder strap; and a plurality of adjustable length carrying straps connected to said portion of said shoulder strap stiffened by said support, said carrying straps oriented transversely relative to said shoulder strap and sewn to said shoulder strap, said carrying straps configured for releasably connecting and suspending the article to be carried by the user.

19. A carrying device configured to facilitate a user carrying an article such as a beach chair, folding chair, bag, cooler, table, blanket, toy and floating device, said device comprising:

a substantially rigid support, said support including a support member disposed within a fabric web;

a shoulder strap connected to said support, said shoulder strap configured for suspending said support from a shoulder of the user; and at least one carrying strap connected to said support, said carrying strap configured for releasably connecting and suspending the article to be carried by the user, said carrying strap being oriented transversely relative to said support, and said carrying strap being sewn to said fabric web.

* * * * *